US008876982B2

(12) United States Patent
Neplenbroek et al.

(10) Patent No.: US 8,876,982 B2
(45) Date of Patent: Nov. 4, 2014

(54) WAREWASHING METHOD USING A CLEANING COMPOSITION CONTAINING LOW LEVELS OF SURFACTANT

(75) Inventors: Antonius Maria Neplenbroek, Soest (NL); Bouke Suk, Vinkeveen (NL); Petrus Adrianus Angevaare, Soest (NL); Perrino Marie Portier, Arradon (FR); Bérengère Idelon, Lyons (FR)

(73) Assignee: Diversey, Inc., Sturtevant, WI (US)

( * ) Notice: Subject to any disclaimer, the term of this patent is extended or adjusted under 35 U.S.C. 154(b) by 1088 days.

(21) Appl. No.: 11/416,770

(22) Filed: May 3, 2006

(65) Prior Publication Data

US 2007/0017553 A1 Jan. 25, 2007

Related U.S. Application Data

(60) Provisional application No. 60/677,619, filed on May 4, 2005.

(51) Int. Cl.

| | |
|---|---|
| ***B08B 9/20*** | (2006.01) |
| ***B08B 3/00*** | (2006.01) |
| ***C11D 17/00*** | (2006.01) |
| ***C11D 11/00*** | (2006.01) |
| ***C11D 3/37*** | (2006.01) |
| ***C11D 1/72*** | (2006.01) |
| ***C11D 1/722*** | (2006.01) |

(52) U.S. Cl.

CPC ..... *C11D 1/721* (2013.01); *C11D 17/0052* (2013.01); *C11D 17/0073* (2013.01); *C11D 11/0023* (2013.01); *C11D 3/3776* (2013.01); *C11D 11/0058* (2013.01); *C11D 1/722* (2013.01)

USPC ..... 134/25.2; 134/26; 134/29; 510/220; 510/223; 510/225; 510/230

(58) Field of Classification Search

CPC ..... B08B 9/20; B08B 3/00

USPC ..... 134/18, 25.2, 34, 40, 42, 26, 29; 510/220, 223, 225, 230

See application file for complete search history.

(56) References Cited

U.S. PATENT DOCUMENTS

| | | | | |
|---|---|---|---|---|
| 3,591,509 | A | 7/1971 | Parks et al. | |
| 3,625,854 | A | 12/1971 | Gower et al. | |
| 4,005,025 | A | 1/1977 | Kinstedt | |
| 4,101,456 | A | 7/1978 | Renaud et al. | |
| 4,167,488 | A | 9/1979 | Murtaugh | |
| 4,657,690 | A * | 4/1987 | Grollier et al. | 510/119 |
| 4,663,159 | A | 5/1987 | Brode, II et al. | |
| 5,411,585 | A | 5/1995 | Avery et al. | |
| 5,418,006 | A | 5/1995 | Roth et al. | |
| 5,597,793 | A | 1/1997 | Besse et al. | |
| 5,698,046 | A * | 12/1997 | St. Laurent et al. | 134/25.2 |
| 5,759,980 | A | 6/1998 | Russo et al. | |
| 5,807,438 | A * | 9/1998 | Lansbergen et al. | 134/25.2 |
| 5,876,514 | A | 3/1999 | Rolando et al. | 134/25.2 |
| 6,087,319 | A | 7/2000 | Norman | |
| 6,156,715 | A * | 12/2000 | Lentsch et al. | 510/224 |
| 6,165,972 | A * | 12/2000 | Weinelt et al. | 510/502 |
| 6,172,036 | B1 | 1/2001 | Cruickshank et al. | |
| 6,239,091 | B1 | 5/2001 | Tartakovsky et al. | |
| 6,248,338 | B1 | 6/2001 | Muller et al. | |
| 6,333,299 | B1 | 12/2001 | Pace et al. | |
| 6,368,584 | B1 * | 4/2002 | Garnier et al. | 424/70.22 |
| 6,462,006 | B1 * | 10/2002 | Sorg et al. | 510/220 |
| 6,484,734 | B1 * | 11/2002 | Everson et al. | 134/25.2 |
| RE38,262 | E * | 10/2003 | Rolando et al. | 134/25.2 |
| 6,827,795 | B1 * | 12/2004 | Kasturi et al. | 134/42 |
| 2002/0172656 | A1 | 11/2002 | Biedermann et al. | |
| 2003/0073596 | A1 | 4/2003 | Chiou et al. | |
| 2003/0119706 | A1 | 6/2003 | Pfeiffer et al. | |
| 2005/0022314 | A1 | 2/2005 | Ambuter et al. | |
| 2005/0075258 | A1 * | 4/2005 | Kessler et al. | 510/221 |
| 2006/0058209 | A1 | 3/2006 | Lentsch et al. | |
| 2009/0087390 | A1 | 4/2009 | Modi | |
| 2009/0101168 | A1 | 4/2009 | Swidler | |
| 2011/0034366 | A1 | 2/2011 | Panandiker et al. | |
| 2011/0229420 | A1 | 9/2011 | Oh et al. | |

FOREIGN PATENT DOCUMENTS

| | | |
|---|---|---|
| EP | 0893491 | 1/1999 |
| EP | 1235895 B1 | 9/2002 |
| EP | 1743906 A2 | 1/2007 |

(Continued)

OTHER PUBLICATIONS

International Search Report for PCT/US2008/064626 mailed Nov. 26, 2008.

International Search Report and Written Opinion for PCT/US2006/016582 mailed Aug. 17, 2006.

European Search Report and Opinion issued in EP Application No. 08756167.6, Oct. 10, 2012.

The Notification of Reason for Rejection prepared by the Japanese Patent Office—Dispatch Date: Apr. 4, 2011 (Received correspondence from our Japanese Associate on Aug. 5, 2011 with this information).

English translation of Final Office Action issued in Japanese Patent Application No. 2008-510096, Apr. 2, 2012.

English translation of Office Action issued in Chinese Patent Application No. 200680018912.5, May 7, 2012.

(Continued)

*Primary Examiner* — Saeed T Chaudhry

(74) *Attorney, Agent, or Firm* — Bell & Manning, LLC

(57) ABSTRACT

Disclosed is a method of washing ware in an automatic institutional warewashing machine wherein the method includes contacting ware with a cleaning composition containing a surfactant and further includes contacting the washed ware in a rinse step with a potable aqueous rinse, the aqueous rinse being substantially free of an intentionally added rinse agent. A surfactant is employed in the wash step in an amount not to exceed 15 wt % based on weight of the detergent. The amount of surfactant is sufficient to provide a layer of surfactant on the ware so as to afford a sheeting action in an aqueous rinse step without any added rinse agent.

18 Claims, No Drawings

(56) References Cited

FOREIGN PATENT DOCUMENTS

| | | | | |
|---|---|---|---|---|
| EP | 1721963 | B1 | 2/2008 | |
| ES | 2114218 | T3 | 5/1998 | |
| JP | 09111292 | | 4/1997 | |
| JP | 2001-316700 | | 11/2001 | |
| JP | 2007099811 | | 4/2007 | |
| JP | 2007-169473 | | 7/2007 | |
| JP | 2007169473 | | 7/2007 | |
| WO | WO9011363 | | 10/1990 | |
| WO | WO 96/15710 | | 5/1996 | ..... A47L 15/44 |
| WO | 99/05248 | | 2/1999 | |
| WO | WO 00/68348 | | 11/2000 | |
| WO | 01/85890 | | 11/2001 | |
| WO | WO0206438 | | 1/2002 | |
| WO | WO03070868 | | 8/2003 | |
| WO | WO2004061069 | | 7/2004 | |
| WO | WO2006119162 | | 11/2006 | |
| WO | WO2008002666 | | 1/2008 | |
| WO | 2008/144744 | | 11/2008 | |
| WO | 2008/147940 | | 12/2008 | |
| WO | WO2008147940 | | 12/2008 | |

OTHER PUBLICATIONS

Office Action issued in Canadian Patent Application No. 2,606,817, Jul. 13, 2012.

JP Patent Application Laid-Open No. 2005-054056, Mar. 3, 2005, Kao Corp.

English language translation of Abstract of JP Patent Application Laid-Open No. 2005-054056, Mar. 3, 2005, Kao Corp.

English translation of Office Action issued in Chinese Patent Application No. 200680018912.5, Jan. 8, 2010.

English translation of Office Action received in Japanese Patent Application No. 2008-510096, Apr. 4, 2011.

JP Application Pub. No. 2001316700A, Nov. 16, 2001, Teepol Ltd.

English translation of JP Application Pub. No. 2001316700A, Nov. 16, 2001, Teepol Ltd.

* cited by examiner

WAREWASHING METHOD USING A CLEANING COMPOSITION CONTAINING LOW LEVELS OF SURFACTANT

CROSS-REFERENCE TO RELATED APPLICATION(S), IF ANY

This application claims priority of U.S. Provisional Application Ser. No. 60/677,619 filed on 4 May 2005, European Application No. 05 103 745.5 filed on 4 May 2005 and European Application No. 06 101 471.8 filed on 9 Feb. 2006.

FIELD OF THE INVENTION

This invention relates to an institutional or industrial warewashing detergent and to its use in automatic warewashing machines that operate with a wash and a rinse cycle. The detergent of the invention promotes soil removal in the washing stage and rinsing or rinse water sheeting in the rinsing stage. The detergent includes a low level of surfactant in the wash stage and obviates the dosage of a surfactant in the rinse stage.

BACKGROUND OF THE INVENTION

Current institutional warewash processes involve at least 2 steps; Step 1 which is a main wash, in which the substrates are cleaned by pumping main wash solution over the substrates via nozzles. This main wash solution is obtained by dissolving main wash detergent, which can contain components such as alkalinity agents, builders, bleaches, enzymes, surfactants for defoaming or cleaning, polymers, corrosion inhibitors etc. Step 2 is a rinse step after the main wash. This is done by flowing warm or hot water, containing rinse aid solution, over the substrates, which can be followed by a hot air stream to further improve the drying process. The rinse aid typically consists of non-ionics present in an amount of 10 to 30% in water; often in combination with hydrotropes and sometimes other additives such as polymers, silicones, acids, etc.

A number of machines are used for these institutional warewash processes, such as the so called single tank, dump or multi-tank machines. Typical conditions in these institutional warewash processes are:

A. Constant temperature of main wash in a single tank and dump machines of 50-70° C.

B. Temperature of wash solution in multi-tank machine is about 40° C. in the first (prewash) tank and about 60° C. in the last wash tank.

C. High temperature of rinse solution of 80-90° C. for single tank and multi-tank machine and about 60° C. for dump machines.

D. Short total wash cycles varying from about 40 seconds to 5 minutes. The rinse cycle does not take longer than 2 minutes, and in most cases takes only between 2 and 10 seconds.

E. Wash water being re-used for many wash cycli (with exception of dump machines)

F. Volume of wash solution varying from about 5 to 10 Liter (for dump machine) to 40 Liter (for Single tank re-use machine) to 400 Liter (for multi-tank machine).

G. No carry-over of main wash solution to the final rinse solution for the so called high temperature single- and multi-tank machines. Different pumps, tubes and nozzles are used for the wash solution and rinse solution and the rinse solution is not recirculating through the wash tank during the last rinse.

H. The substrates have to be dry after the final rinse, since this is a more or less continuous batch process where the substrates are cleared away before the next batch of washed and dried substrates are coming out of the machine. These machines are used at facilities (like restaurants, hospitals, cantines) where many substrates are washed in a short period of time.

The machine and process conditions for these institutional dishwasing processes differ significantly from the conditions for domestic type of dishwash machines. Most important features of domestic dishwashing that differ from institutional ware washing are:

A. Domestic dishwash process takes about 30 minutes to 1.5 hour. The rinse cycles in these processes vary from about 5 to 40 minutes.

B. Wash solution is not re-used in the domestic dishwash process

C. Part of the wash solution is carried over into the rinse solution (e.g. via the same pump, tubes and nozzles that are used for washing and rinsing and because the rinse solution is recirculated through the wash tank during rinsing).

D. Temperature in domestic wash process is totally different; normally cold water is used for filling the machines. This water is heated up to about 60 degrees C. during the wash process.

E. Volume wash solution is about 3 to 10 Liter.

F. After the wash and rinse process there is sufficient time left for the substrates to dry further. This is facilitated by the warm conditions in the closed domestic dishwash machine.

An important recent trend in domestic dishwashing is the development of dishwash products which can be used in domestic dishwash machines without the need for a separate rinse product to be added to the final rinse solution. A key driver for this development is simplicity.

These products, often tablets, contain ingredients which facilitate the drying process. The main objective is to obtain improved visual appearance of the substrates. The most important drying-ingredients in these, so called 2-in-1 or 3-in-1 products, are polymers and non-ionics.

Crucial parameters/conditions for obtaining acceptable drying properties by this so called built-in rinse concept in domestic dishwashing machines are:

A. Carry-over of some part of the main wash solution, containing the drying ingredients, into the rinse solution. This carry-over typically takes place via the same pump, tubes and nozzles that are used for washing and rinsing and because the rinse solution is recirculated through the wash tank with dish ware during rinsing.

B. Relatively long washing time and rinsing time.

C. Relatively high area of machine surface (walls) and dish ware, on which drying components (polymers and non-ionics) will remain in the residual water that clings onto the machine parts and the dish ware. A part of the rinse components in the last rinse solution is derived from this residual water. This process of carry over of rinse components from the main wash into the rinse solution will be stimulated further when a part of the wash solution is present as foam at the end of the main wash cycle.

Despite these conditions, the drying results in domestic dishwashing machines by these tablets with built in rinse components is often inferior to drying by adding rinse component into the rinse via a separate rinse aid.

Institutional warewashing processes are characterised by very short wash and rinse cycles, i.e. by a very short contact time between the wash solution and the substrates and between the rinse solution and the substrates. In addition, in institutional high temperature single- and multi-tank machines there is no carry-over of the wash solution via the pump, tubes and nozzles of the machine and no carry-over by adsorption and subsequent desorption via the machine walls (since the rinse solution is not recirculated in the wash tank). Therefore, the concept of built-in rinse components is not expected to work in institutional warewashing processes. Furthermore, reduced drying times are much more important for institutional warewashing processes than for domestic dishwashing, where emphasis is on visual appearance.

Therefore, all proper warewashing processes in institutional warewashing machines require the need for rinse components to be present in the final rinse solution, which are introduced by dosing a separate rinse aid in this rinse solution.

One attempt to develop a main wash detergent product for institutional warewashing machines with a built-in rinse component is described in U.S. Pat. No. RE 38,262. In this patent high levels of non-ionics (20-40%) are needed to obtain visual drying benefits when not adding rinse agent to the rinse water. This amount of rinse agent ensures that the detergent composition contains sufficient source of alkalinity and other components to adequately clean the dishes while leaving a sufficient concentration of a rinse agent residue on the layer and the internal structures of the machine including rack and ware, spray arms, walls, etc. to promote rinsing or sheeting in the potable water rinse cycle. In particular, it has been found in U.S. Pat. No. RE 38,262 that the concentration of the nonionic sheeting agent in the aqueous rinse commonly is about 20 to 40 parts by weight or more per million parts of the aqueous rinse if the alkaline detergent material contains greater than about 25 wt % of the nonionic sheeting agent.

The process described in the examples of U.S. Pat. No. RE 38,262 has high similarity to the carry over effects which lead to built in rinse effects in domestic dishwashing processes. Crucial is that nonionics are dissolved in the rinse solution and so lead to improved visual drying effects. The level of carry over is determined by the type of warewashing machine and for that reason the so called dump low temp machines are preferred for this process.

These high levels of nonionics are very difficult to incorporate in a main wash detergent without sacrificing physical properties like flow and stability and will lead to high costs.

SUMMARY OF THE INVENTION

A method of washing ware using a cleaning composition containing a surfactant is presented which involves contacting ware in a washing step with an aqueous cleaning composition in an automatic institutional warewashing machine. The aqueous cleaning composition contains a major portion of an aqueous diluent and about 200 to 5000 parts by weight of a warewashing detergent per each one million parts of the aqueous diluent. The detergent contains a surfactant present in an amount not to exceed 15 wt-%. The washed ware is contacted in a rinse step with a potable aqueous rinse. The aqueous rinse is substantially free of an intentionally added rinse agent. Preferably, no rinse agent is intentionally added to the potable aqueous rinse. The warewashing detergent contains sufficient adsorbing surfactant to provide a layer of surfactant on the ware so as to afford sheeting action in the potable aqueous rinse step.

In the method of the invention, the washing step preferably does not exceed 10 minutes, more preferably does not exceed 5 minutes. In addition, the aqueous rinse step preferably does not exceed 2 minutes.

A surfactant that is suitable for use in the warewashing detergent should be low foaming in the institutional warewashing process and should sufficiently adsorb on a solid surface leading to overall reduced drying times.

A preferred surfactant is selected from the group consisting of nonionic surfactants and polymeric surfactants.

A preferred nonionic surfactant is a compound obtained by the condensation of alkylene oxide groups with an organic hydrophobic material which may be aliphatic or alkyl aromatic in nature, preferably is a compound selected from the group consisting of a C2-C18 alcohol alkoxylate having EO, PO, BO and PEO moieties or a polyalkylene oxide block copolymer.

A preferred polymeric surfactant is a homo- or copolymeric polycarboxylic acid or polycarboxylate. Suitable polymeric polycarboxylic compounds are (meth)acrylic acid homopolymers, copolymers of acrylic and/or methacrylic acid with maleic acid and/or copolymers of maleic acid with olefins.

In one aspect, the surfactant is adsorbed onto the ware during the washing step with a subsequent lowering of the contact angle of rinse water contacting the surface of the ware, leading to reduced thickness of the rinsewater film and so resulting in sheeting action. This results in faster drying of the substrates when rinsed with fresh water.

In yet another aspect, a single tank warewash machine is employed which is operated at a temperature of between 50-60° C. in the washing step and about 80-90° C. in the rinse step.

DETAILED DESCRIPTION OF THE INVENTION

In the method of this invention, ware is washed in an automatic institutional warewashing machine which for instance can be a single tank or a multi-tank machine. The following materials can be employed.

Surfactants

A surfactant that is suitable for use in the method of the invention should be low foaming in the institutional warewashing process and should sufficiently adsorb on a solid surface leading to overall improved drying behaviour (reduced drying time).

To determine the suitability of surfactants for the method of this invention, the drying behaviour of a substrate is compared under identical conditions using an institutional warewashing process comprising a main wash step and a rinse step, wherein a detergent composition is used in the main wash step with or without the presence of surfactant, followed by a rinse step with fresh water, i.e. water without added rinse aid, such as tap water.

A surfactant that is suitable for use in the method of the invention provides an improved drying behaviour corresponding to the ratio $$\frac{\text{drying time using detergent with surfactant}}{\text{drying time using detergent without surfactant}}$$

being equal to or lower than 0.9, preferably equal to or lower than 0.8, more preferably equal to or lower than 0.7, even more preferably equal to or lower than 0.6, even more preferably equal to or lower than 0.5, even more preferably equal to or lower than 0.4, most preferably equal to or lower than 0.3, and being measured under identical conditions except for presence or absence of the surfactant to be tested in the detergent. The lower limit of this ratio typically may be about 0.1.

Drying behaviour is measured on 3 different types of substrates. These are coupons which typically are difficult to dry in a institutional ware washing process without the use of rinse components. These substrates are:

2 glass coupons (148*79*4 mm)

2 plastic ('Nytralon 6E' (Quadrant Engineering Plastic Products); naturel) coupons (97*97*3 mm)

2 stainless steel (304) coupons (150*35*1 mm)

The drying behaviour is measured as drying time (seconds) for glass and steel and as residual amount of droplets after 5 minutes drying for plastic. Measurements typically are started immediately after opening the machine.

The concentration of the tested surfactant typically is 4 to 8 wt % in the detergent composition.

Care should be taken to choose such test conditions that provide proper differences in drying behaviour with and without surfactant. For instance, those conditions are suitable that give a proper difference in drying time when comparing a process with a common rinse aid added to the rinse water with a process using detergent without surfactant and a rinse step with fresh water. Typical drying times for such processes may be about 2 and about 4 minutes, respectively. Suitable conditions are for instance those of examples 1, 2 or 8. A common rinse aid may be a nonionic surfactant dosed at about 100 ppm in the rinse water, for instance Rinse Aid A (see example 1).

The detergent composition that may be used for this comparison typically contains metasilicate, phosphate and hypochlorite, e.g. 0.4 g/l sodium tripoly phosphate (STP; LV 7 ex-Rhodia)+0.285 g/l sodium metasilicate 0 aq (SMS 0 aq.)+0.285 g/l sodium metasilicates 5 aq (SMS 5 aq.)+0.03 g/l dichloroisocyanuric acid Na-salt 2 aq (NaDCCA).

Nonionic Surfactants

Preferred surfactants are nonionic surfactants which can be broadly defined as surface active compounds with one or more uncharged hydrophilic substituents. A major class of nonionic surfactants are those compounds produced by the condensation of alkylene oxide groups with an organic hydrophobic material which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative, but not limiting examples, of various suitable nonionic surfactant types are mentioned below.

C2-C18 alcohol alkoxylate having EO, PO, BO and PEO moieties or a polyalkylene oxide block copolymer.

Polyoxyalkene condensates of aliphatic carboxylic acids, whether linear- or branched-chain and unsaturated or saturated, especially ethoxylated and/or propoxylated aliphatic acids containing from about 8 to about 18 carbon atoms in the aliphatic chain and incorporating from about 2 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid.

Polyoxyalkene condensates of aliphatic alcohols, whether linear- or branched-chain and unsaturated or saturated, especially ethoxylated and/or propoxylated aliphatic alcohols containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol.

Ethoxylated fatty alcohols may be used alone or in admixture with anionic surfactants. The average chain lengths of the alkyl group $R_{11}$ in the general formula:

$$R_{11}O(CH_2CH_2O)_nH$$

$R_{11}$ is from 6 to 20 carbon atoms. Notably the group $R_{11}$ may have chain lengths in a range from 9 to 18 carbon atoms.

The average value of n should be at least 2. The numbers of ethylene oxide residues may be a statistical distribution around the average value. However, as is known, the distribution can be affected by the manufacturing processor altered by fractionation after ethoxylation.

Examples are ethoxylated fatty alcohols having a group $R_{11}$ which has 9 to 18 carbon atoms while n is from 2 to 8.

Other example types of nonionic surfactants are linear fatty alcohol alkoxylates with a capped terminal group, as described in U.S. Pat. No. 4,340,766 to BASF.

Another nonionic surfactant included within this category are compounds of formula:

$$R_{12}—(CH_2CH_2O)_qH$$

wherein $R_{12}$ is a $C_6$-$C_{24}$ linear or branched alkyl hydrocarbon radical and q is a number from 2 to 50; more preferably $R_{12}$ is a $C_8$-$C_{18}$ linear alkyl mixture and q is a number from 2 to 15.

Polyoxyethylene or polyoxypropylene condensates of alkyl phenols, whether linear- or branched-chain and unsaturated or saturated, containing from about 6 to 12 carbon atoms and incorporating from about 2 to about 25 moles of ethylene oxide and/or propylene oxide. Polyoxyethylene derivatives of sorbitan mono-, di-, and tri-fatty acid esters wherein the fatty acid component has between about 12 and about 24 carbon atoms. Example type of polyoxyethylene derivatives are of sorbitan monolaurate, sorbitan trilaurate, sorbitan monopalmitate, sorbitan tripalmitate, sorbitan monostearate, sorbitan monoisostearate, sorbitan tristearate, sorbitan monooleate, and sorbitan trioleate. The polyoxyethylene chains may contain between about 4 and about 30 ethylene oxide units, preferably about 10 to about 20. The sorbitan ester derivatives contain 1, 2 or 3 polyoxyethylene chains dependent upon whether they are mono-, di- or tri-acid esters.

Polyoxyethylene-polyoxypropylene block copolymers having formula:

$$HO(CH_2CH_2O)_a(CH(CH_3)CH_2O)_b(CH_2CH_2O)_cH$$

or $$HO(CH(CH_3)CH_2O)_d(CH_2CH_2O)_e(CH(CH_3)CH_2O)_fH$$

wherein a, b, c, d, e and f are integers from 1 to 350 reflecting the respective polyethylene oxide and polypropylene oxide blocks of said polymer. The polyoxyethylene component of the block polymer constitutes at least about 10% of the block polymer. The material can for instance have a molecular weight of between about 1,000 and about 15,000, more specifically from about 1,500 to about 6,000. These materials are well-known in the art. They are available under the trademark "Pluronic" and "Pluronic R", a product of BASF Corporation.

Polymeric Surfactants

Preferred polymeric surfactants are homo- or copolymeric polycarboxylic acids or polycarboxylates, for example those having a molecular weight in the range from 800 to 150,000. Suitable polymeric polycarboxylic compounds are (meth) acrylic acid homopolymers, copolymers of acrylic and/or methacrylic acid with vinyl monomers like styrene or maleic anhydride and/or copolymers of maleic acid with olefins.

Suitable acrylic polymers are those sold under the trade mark Sokalan PA by BASF or Alcosperse by Alco. Suitable copolymers of (meth)acrylic acid with other vinyl monomers, are acrylic/maleic acid copolymers such as sold by BASF under the trademark Sokalan or sold by Alco under the trademark of Alcosperse, Narlex and Versaflex.

Especially preferred are maleic acid/olefin copolymers having having the formula

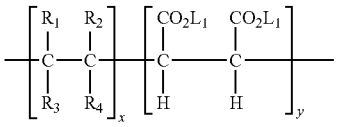

wherein $L_1$ is selected frown the group of hydrogen, ammonium or an alkali metal; and $R_1$, $R_2$, $R_3$ and $R_4$ are each independently selected from the group of hydrogen or an alkyl group (straight or branched, saturated or unsaturated) containing from 1 to about 8 carbon atoms, preferably from 1 to about 5 carbon atoms. The monomer ratio of x to y is from about 1:5 to about 5:1, preferably from about 1:3 to about 3:1, and most preferably from 1.5:1 to about 1:1.5. The average molecular weight of the copolymer will typically be less than about 20,000, more typically between about 4,000 and about 12,000.

A preferred maleic acid-olefin copolymer is a maleic acid-di-isobutylene copolymer having an average molecular weight of about 12,000 and a monomer ratio (x to y) of about 1:1. Such a copolymer is available from the BASF Corporation under the trademark "Sokalan CP-9". $L_1$ is hydrogen or sodium, $R_1$ and $R_3$ are hydrogen, $R_2$ is methyl, and $R_4$ is neopentyl. Another preferred product is a maleic acid-trimethyl isobutylene ethylene copolymer. $L_1$ is hydrogen or sodium, $R_3$ and $R_1$ are each methyl, $R_2$ is hydrogen and $R_4$ is tertiary butyl.

It is found that the copolymers are especially preferred when interacting with 2+ or 3+ positively charged metal ions, like calcium ($Ca^{2+}$), magnesium ($Mg^{2+}$) ions or aluminium ($Al^{3+}$), in the wash solution. These ions (especially calcium and magnesium) could be present as water hardness minerals in tap water, or could for instance be added to the wash solution together with these copolymers. It is found that the combination of these copolymers with these 2+/3+ metal ions is especially effective in the concept of built in rinse for institutional warewashing as described herein.

Another preferred polymeric surfactant is based on pyrrolidone, such as Poly Vinyl Pyrrolidones (PVP).

Another preferred polymeric surfactant is a polyhydroxyamide.

Other preferred polymeric surfactants are found in the group of polypeptides. Especially preferred are caseins.

Another preferred polymeric surfactant is found in the group of hydrophobically modified polysaccharides, such as a hydrophobically modified inulin.

Particularly preferred are the following surfactants:

- Fatty alcohol alkoxylates such as Adekanol B2020 (Adeka), Dehypon LS36 (Cognis), Plurafac LF 221 (C13-15, EO/BO (95%)), Plurafac LF 300, Plurafac LF 303 (EO/PO), Plurafac LF 1300, Degressal SD 20 (polypropoxylate) (all from BASF), Surfonic LF 17 (C12-18 ethoxylated propoxylated alcohol, Huntsman), Triton EF 24 (Dow);
- Alkoxypolyethylbenzylethers such as Triton DF 12 or DF18 (DOW);
- Acrylic acid homopolymers such as Alcosperse 602 TG (acrylic acid homopolymer, Mw 6000, Alco), Sokalan PA40 (polyacrylic acid, Na-salt, Mw 15000), Sokalan PA15 (polyacrylic acid, sodium salt, Mw 1200) (BASF);
- Copolymers such as Sokalan CP9 (maleic acid/olefin-copolymer, Na-salt, Mw 12000), Sokalan CP5 (maleic acid/acrylic acid copolymer, Na-salt, Mw 70000), Sokalan PM 70 (modified polycarboxylate, Na salt, Mw 20000 (BASF), Versaflex SI (acrylic copolymer), Alcosperse 175 (maleic/acrylic acid copolymer, Mw 75000), Narlex LD 36V (acrylic acid copolymer, Mw 5000), Narlex LD 54 (acrylic acid copolymer, Mw 5000) (Alco);
- Polymeric pyrollidones such as Surfadone LP-100 (N-Octyl-2-Pyrrolidone, ISP) or polyvinylpyrrolidones such as PVP K-30, PVP K-60, PVP K-90 PVP K-120 (ISP);
- Polyhydroxyamides such as Anticor A 40 (ADD APT Chemicals BV);
- Polypeptides such as Casein;
- Hydrophobically modified polysaccharides such as a hydrophobically modified inulin (Inutec SP 1, Orafti BBC).

These surfactants can be used alone or in combination in the detergent composition.

Preferred combinations are for instance Sokalan CP9 and Degressal SD 20; Plurafac LF 1300 and Sokalan CP9; Plurafac LF 300 and Degressal SD 20 and Sokalan CP 5; Plurafac LF 300 and Degressal SD 20 and Sokalan PA 40; Plurafac LF 300 and Degressal SD 20 and Versaflex SI; Plurafac LF 300 and Degressal SD 20 and Alcosperse 175; Plurafac LF 300 and Degressal SD 20 and Narlex LD 54.

The preferred concentration range of surfactant is from about 0.5 to about 15% by wt., more preferably from about 0.5 to about 10% by weight, most preferably from about 3 to about 7% by weight of the detergent composition.

Detergent Composition

In addition to the essential ingredients described herein above, the presently disclosed compositions may be formulated as detergent compositions having conventional ingredients, preferably selected from alkalinity sources, builders (i.e. detergency builders including the class of chelating agents/sequestering agents), bleaching systems, anti-scalants, corrosion inhibitors, antifoams and enzymes. Suitable caustic agents include alkali metal hydroxides, e.g. sodium or potassium hydroxides, and alkali metal silicates, e.g. sodium metasilicate. Especially effective is sodium silicate having a mole ratio of $SiO_2$:$Na_2O$ of from about 1.0 to about 3.3, preferably from about 1.8 to about 2.2, normally referred to as sodium disilicate.

Builder Materials

Suitable builder materials (phosphates and non-phosphate builder materials) are well known in the art and many types of organic and inorganic compounds have been described in the literature. They are normally used in all sorts of cleaning compositions to provide alkalinity and buffering capacity, prevent flocculation, maintain ionic strength, extract metals from soils and/or remove alkaline earth metal ions from washing solutions.

The builder material usable herein can be any one or mixtures of the various known phosphate and non-phosphate builder materials. Examples of suitable non-phosphate builder materials are the alkali metal citrates, carbonates and bicarbonates; and the salts of nitrilotriacetic acid (NTA); methylglycine diacetic acid (MGDA); polycarboxylates such as polymaleates, polyacetates, polyhydroxyacrylates, polyacrylate/polymaleate and polyacrylate/polymethacrylate copolymers, as well as zeolites; layered silicas and mixtures thereof. They may be present (in % by wt.), in the range of from 1 to 70, and preferably from 5 to 60, more preferably from 10 to 60.

Particularly preferred builders are phosphates, NTA, EDTA, MGDA, citrates, carbonates, bicarbonates, polyacrylate/polymaleate, maleic anhydride/(meth)acrylic acid copolymers, e.g. Sokalan CP5 available from BASF.

Antiscalants

Scale formation on dishes and machine parts can be a significant problem. It can arise from a number of sources but, primarily it results from precipitation of either alkaline earth metal carbonates, phosphates or silicates. Calcium carbonate and phosphates are the most significant problem. To reduce this problem, ingredients to minimize scale formation can be incorporated into the composition. These include polyacrylates of molecular weight from 1,000 to 400,000 examples of which are supplied by Rohm & Haas, BASF and Alco Corp. and polymers based on acrylic acid combined with other moieties. These include acrylic acid combined with maleic acid, such as Sokalan CP5 and CP7 supplied by BASF or Acusol 479N supplied by Rohm & Haas; with methacrylic acid such as Colloid 226/35 supplied by Rhone-Poulenc; with phosphonate such as Casi 773 supplied by Buckman Laboratories; with maleic acid and vinyl acetate such as polymers supplied by Huls; with acrylamide; with sulfophenol methallyl ether such as Aquatreat AR 540 supplied by Alco; with 2-acrylamido-2-methylpropane sulfonic acid such as Acumer 3100 supplied by Rohm & Haas or such as K-775 supplied by Goodrich; with 2-acrylamido-2-methylpropane sulfonic acid and sodium styrene sulfonate such as K-798 supplied by Goodrich; with methyl methacrylate, sodium methallyl sulfonate and sulfophenol methallyl ether such as Alcosperse 240 supplied by Alco; polymaleates such as Belclene 200 supplied by FMC; polymethacrylates such as Tamol 850 from Rohm & Haas; polyaspartates; ethylenediamine disuccinate; organo polyphosphonic acids and their salts such as the sodium salts of aminotri(methylenephosphonic acid) and ethane 1-hydroxy-1,1-diphosphonic acid. The anti-scalant, if present, is included in the composition from about 0.05% to about 10% by weight, preferably from 0.1% to about 5% by weight, most preferably from about 0.2% to about 5% by weight.

Bleaches

Suitable bleaches for use in the system according the present invention may be halogen-based bleaches or oxygen-based bleaches. More than one kind of bleach may be used.

As halogen bleach, alkali metal hypochlorite may be used. Other suitable halogen bleaches are alkali metal salts of di- and tri-chloro and di- and tri-bromo cyanuric acids. Suitable oxygen-based bleaches are the peroxygen bleaches, such as sodium perborate (tetra- or monohydrate), sodium carbonate or hydrogen peroxide.

The amounts of hypochlorite, di-chloro cyanuric acid and sodium perborate or percarbonate preferably do not exceed 15%, and 25% by weight, respectively, e.g. from 1-10% and from 4-25% and by weight, respectively.

Enzymes

Amylolytic and/or proteolytic enzymes would normally be used as an enzymatic component. The amylolytic enzymes usable herein can be those derived from bacteria or fungi.

Minor amounts of various other components may be present in the chemical cleaning system. These include solvents, and hydrotropes such as ethanol, isopropanol and xylene sulfonates, flow control agents; enzyme stabilizing agents; anti-redeposition agents; corrosion inhibitors; and other functional additives.

Components of the present invention may independently be formulated in the form of solids (optionally to be dissolved before use), aqueous liquids or non-aqueous liquid (optionally to be diluted before use).

The warewashing detergent may be in the form of a liquid or a powder. The powder may be a granular powder. When in powder form, a flow aid may be present to provide good flow properties and to prevent lump formation of the powder. The detergent preferably may be in the form of a tablet or a solid block. Also preferably, the detergent may be a combination of powder and tablet in a sachet, to provide a unit dose for several washes.

Typical institutional ware washing processes are either continuous or non-continuous and are conducted in either a single tank or a multi-tank/conveyor type machine. In the conveyor system pre-wash, wash, post-rinse and drying zones are generally established using partitions. Wash water is introduced into the rinsing zone and is passed cascade fashion back towards the pre-wash zone while the dirty dishware is transported in a counter-current direction.

The inventive chemical cleaning system may be utilized in any of the conventional automatic institutional ware washing processes.

This invention will be better understood from the Examples which follow. However, one skilled in the art will readily appreciate that the specific methods and results discussed are merely illustrative of the invention and no limitations of the invention is implied.

Trials looking into the effect of relatively low levels of different types of surfactants (nonionics and/or polymers) added to main wash solutions on the drying of substrates in a institutional warewash process, showed surprising effects. It was found that proper drying of substrates in these wash processes can be achieved even by rinsing with fresh water, so without addition of rinse components into the rinse solution by dosing rinse aid. These proper drying results are obtained already at relatively low levels (20 to 50 ppm) of certain types of non-ionics and/or polymeric surfactants in the main wash solution. Further more surprisingly is that these proper drying effects are obtained even in standard single tank high temperature warewash machines where no carry over and dissolving of rinse components from the wash water, machine wall, spray arms, ware and racks into the rinse solution is possible: see example 1.

These results are surprising, since, as mentioned above, the conditions which lead to drying in a domestic dishwash machine via a built in rinse concept are not present in institutional warewash machines. Obviously, these drying effects obtained via the presence of low level of certain non-ionics and/or polymeric surfactants in the main wash of institutional warewashing processes are caused by a different mechanism than the drying effects obtained in domestic dishwash processes or the drying effects obtained via carry-over of high levels of non-ionic into the rinse solution as described in U.S. Pat. No. RE 38,262.

Trials studying the mechanisms of these phenomena indicate that surfactants can adsorb onto the ware during the wash step with a subsequent decrease of the contact angle when contacted by the rinse water, leading to reduced thickness of the rinsewater film and so resulting into faster drying of the substrates when rinsed with fresh water. Further tests indicate that this process of drying substrates by adsorption of surfactants during the main wash and subsequent rinsing with fresh water is especially suitable for wash processes with a short rinse cycle, as is the case for wash processes in institutional warewash machines.

These relatively low levels of surfactants (preferred range from 3 to 7% in solid main wash detergent) can be incorporated rather easily in main wash detergents like tablets, blocks, powders or granules without sacrificing physical properties like flow and stability.

The surfactant, incorporated in the wash detergent, can be in a liquid form, but also in solid form. When needed, the stability of the surfactant in the wash detergent can be improved in several ways in order to prevent chemical reaction with other components from the ware washing detergent (like caustic, hypochlorite). Some options are:

A. Absorbing the surfactant in a porous material before mixing with the other warewashing components; e.g. absorbing in sodium tripolyphoshate, sodium sulfate, sodium carbonate, sodium metasilicate, sodium disilicate, bentonite or other type of clay.

B. Incorporating the surfactant in a granule with another material in a granulation process ('co-granulation'); e.g. spray drying during granulation of sodium tripolyphoshate, sodium sulfate, soda ash, NTA.

C. Encapsulating the surfactant or the absorbed or co-granulated surfactant by another material (e.g. by starch, polymer or sodium carbonate) before mixing with the other warewashing components.

With this concept of built in rinse, a simpler wash process is obtained for institutional warewashing, which eliminates the need for using a separate rinse aid. Besides increased simplicity, this concept provides clear cost savings, like for raw materials, packaging, processing, transport and storage of the separate rinse aid, but also by eliminating the need for a pump to dose the rinse aid into the rinse solution.

Furthermore it was found:

A. The presence of low levels of non-ionics in the main wash solution of institutional warewash processes do not only lead to faster drying of the substrates, but also better visual appearance of the substrates: less residues (like spots or streaks/films) are being formed by this process where the last rinse consists of fresh water only: see example 3.

B. Improved, synergistic, drying effects are obtained by having certain combinations of non-ionics in the main wash process: see example 2.

C. Proper drying of a variety of substrates (based on e.g. ceramic, glass, metal and plastic material) can be obtained by certain polymeric surfactants individually and by combining certain non-ionics with certain polymers in the main wash solution: see example 1G and example 8. Some polymeric surfactants (e.g. maleic acid/olefin copolymers such as Sokalan CP9) will also provide proper drying on a variety of substrates, without the presence of nonionic surfactants. The drying properties are optimal when the maleic acid/olefin copolymer is combined with polyvalent cations in the wash solution: see example 9. A defoaming type of nonionic surfactant can be present to prevent foam formation.

D. The most optimal type of non-ionics for this process in which drying of the substrates is achieved by contact of the substrates with these non-ionics in the main wash are different from the type of non-ionics that provide best drying properties when used in a separate rinse aid, as dosed in the final rinse.

E. The level of certain non-ionics, needed to obtain proper drying as present in the main wash solution is significantly less than the level of non-ionics that are typically added to the final rinse water: see example 1. This leads to cost savings for the overall process.

F. These improved drying properties by the presence of certain non-ionics and/or polymers in the main wash are obtained in combination with liquid main wash detergents (containing other ingredients likes NTA and caustic) or with solid main wash products (containing other ingredients like STP, caustic and chlorine: see examples 1, 2 and 8.

G. The improved drying properties can also be obtained with certain end-capped non-ionics. These end-capped non-ionics provide better stability in combination with components like caustic and chlorine.

H. The improved drying properties by the presence of certain non-ionics in the main wash are also obtained for a so called low temp (or 'dump') institutional warewashing process.

I. The drying effects by the presence of certain non-ionics and/or polymers in the main wash solution of institutional warewash process are obtained under the controlled conditions in the laboratory, but are confirmed also under practical conditions including real soils in the wash bath of a multi-tank.

Other benefits of such a process of rinsing via specific component in the mainwash are:

J. By rinsing in the last step with fresh water, without the presence of rinse components as in standard warewashing processes, cleaner substrates are obtained. No rinse aid is dosed in the last rinse and so no rinse aid surfactants will stay behind on the dishes, which eliminates any safety risk which these remaining rinse aid surfactants might have when using the substrates for food contact.

K. The type of non-ionics and polymers which provide optimal drying properties in this concept of built-in rinse for institutional warewash processes can have some cleaning, defoaming, builder, scale prevention or corrosion inhibition properties as well and so improve the overall wash process.

The type of ingredients used in these main wash detergents with most optimal surfactants incorporated for delivering proper drying via main wash solution can be used also in standard institutional warewash processes, where a separate rinse aid is applied for proper drying. However, what is new in this concept is that these products with built-in rinse properties are used in a different institutional wash process, without adding rinse components into the last rinse.

Example 1

In this example the drying behaviour of various substrates is tested in an institutional single tank warewash machine. A standard institutional wash process is applied for this test with a main wash process containing alkalinity, phosphate and hypochlorite. First (test 1A) the drying behaviour of this process with a standard rinse process is determined. In this standard rinse process a rinse aid is dosed in the separate rinse.

Then (test 1B) the drying behaviour is determined for a wash process in which no rinse components are present (not dosed via the separate rinse and not added to the main wash process).

Then (tests 1 C up to 1 G) the drying behaviour is determined for various wash processes in which no rinse component is dosed in the separate rinsed (so rinsed only with fresh water) but where different type of surfactants (or mixtures) are added to the main wash together with the other main wash components. These surfactants are:

Adekanol B2020 (test 1C)

Plurafac LF 303 (test 1D)

Mixture of Plurafac LF 221 and Plurafac LF 303 (test 1E)

Surfonic LF 17 (test 1 F)

Mixture of Surfonic LF 17 and Sokalan PM 70 (test 1 G).

The warewasher is a Hobart-single tank hood machine, which is automated for laboratory testing, such that the hood is opened and closed automatically and the rack with ware is transported automatically into and out off the machine. Specifications single tank hood machine (for example 1)

Type: Hobart AUX70E

Volume washbath: 50 L

Volume rinse: 1 L (2 seconds)

Wash time: 30 seconds

Rinse time: 2 seconds

Wash temperature: 50-55° C.

Rinse temperature: 80° C.

Process

When the wash bath is filled with soft water and heated up, the wash program is started. The washwater will be circulated in the machine by the internal wash pump and the wash arms over the dishware. When the wash time is over, the wash pump will stop and the wash water will stay in the reservoir below the substrates. Then 4 L of the wash bath will be drained automatically by a pump into the drain. Then the rinse program will start; fresh warm water from the boiler (directly connected to a tap) will be rinsed by the rinse arms over the dishware. When the rinse time is over the machine is opened.

It should be noticed that (in contrast to consumer type of dishwash machines) only fresh water is rinsed over the substrates: no components from the main wash process can dissolve in the rinse water. The wash pump and wash arms and nozzles are not used for rinsing and the rinse water is not circulating in the wash tank during rinsing.

Working Method

The parameters for this test are set (wash cycle: 30 seconds at 50° C., rinse cycle: 2 seconds at 80° C. with fresh water) and once the machine is filled with soft cold water and temperature of water is 50° C., the main wash powder (and surfactant to be tested) are added via a plate on the rack. One wash cycle is done to be sure that the product is totally dissolved. Main wash powder is: 0.6 g/l sodium tripoly phosphate (STP; LV 7 ex-Rhodia)+0.37 g/l sodium hydroxide (NaOH)+0.03 g/l dichloroisocyanuric acid Na-salt·2 aq (NaDCCA).

Drying times are measured on 6 different types of substrates:

2 white undecorated ceramic plates 2 plastic trays 2 glass bowls 2 blue plastic cups 2 white undecorated ceramic cups Cutlery: 2 stainless steel spoons and 2 stainless steel knifes After the rack with the above mentioned substrates is placed in the Hobart machine, the wash cycle (40 seconds) and rinse cycle (2 seconds with fresh water) are runned and the timer starts as soon as the warewasher starts with opening the hood. When the rack is in the start position, the door is opened, the top of the plastic and ceramic cups are dried, and the drying time (in seconds) of the washed substrates at ambient temperature are determined.

For the evaluation of the drying times the areas in contact with the rack, the edge of the plates and the trays, and the inside of the bowls and the cups are not considered.

The wash cycle and the drying time measurements are repeated two more times with the same substrates and without adding any chemicals.

Remarks

The substrates are replaced for every new series of tests (in order not to influence the drying results by components possibly adsorbed onto the ware).

When drying time is longer than 300 s, it is reported as 300 s.

Results

In the table below the average drying times in seconds of 3 wash cycli for each of these tests are given. The substrates are ceramic plates (1), ceramic cups (2), glass bowls (3), plastic trays (4), cutlery (5) and pale blue cups (6).

| | | 1 | 2 | 3 | 4 | 5 | 6 |
|---|---|---|---|---|---|---|---|
| All tests 1A to 1G: Mainwash: 0.6 g/l STP + 0.37 g/l NaOH + 0.03 g/l NaDCCA | | | | | | | |
| 1A | No other components added to main wash; separate Rinse Aid A; 0.4 g/L. | 107 | 152 | 53 | 214 | 103 | 113 |
| 1B | No other components added to main wash: reference | 76 | 217 | 99 | 237 | 230 | 300 |
| Surfactant added to main wash | | | | | | | |
| 1C | 50 ppm Adekanol B2020 | 128 | 166 | 73 | 158 | 97 | 174 |
| 1D | 50 ppm Plurafac LF303 | 155 | 184 | 97 | 179 | 185 | 269 |
| 1E | 25 ppm Plurafac LF221 + 25 ppm Plurafac LF303 | 135 | 186 | 86 | 181 | 128 | 222 |
| 1F | 50 ppm Surfonic LF17 | 129 | 204 | 154 | 149 | 133 | 219 |
| 1G | 25 ppm Surfonic LF17 + 25 ppm Sokalan PM 70 | 114 | 125 | 68 | 156 | 127 | 248 |

Test 1A Reference Test for Standard Dish Wash Process

In this reference test the drying effects are measured for a representative standard institutional dish wash process in which drying of the ware is obtained by rinsing with a rinse solution in which rinse aid is dosed.

These rinse components are dosed via a separate rinse pump just before the boiler into the last rinse water. Three wash cycles are done before the test starts, in order to be sure that the rinse aid is homogenously distributed through the boiler.

In this example Rinse Aid A is used as representative rinse aid for institutional warewashing. This neutral rinse aid contains about 30% of a non-ionic mixture. By dosing this rinse aid at a level of 0.4 g/L, the concentration of non-ionics in the rinse solution is about 120 ppm.

Key Components of Rinse Aid A

| As supplied | Raw material | Trade name |
|---|---|---|
| 22.5% | Alcohol (C13–15) alkoxylate (EO/BO) (95%) | Plurafac LF221 |
| 7.5% | Alcohol alkoxylate (EO/PO) | Plurafac LF403 |
| 5.0% | Cumene sulphonic acid Na-salt (40%) | Eltesol SC40 |
| 65.0% | Water | Water |

Test 1 B Reference Test without the Presence of Specially Added Drying Components In this test, the drying times are measured for a similar wash process, but now without dosing rinse components in the rinse solution; so only rinsing with fresh water.

These results show that relatively long drying times are obtained; this confirms the effects of rinse components in the last rinse, which is current standard.

Test 1 C, D, E, F, G Test in which Surfactants are Added in the Main Wash Process and Rinsed with Fresh Water Only In these test series, the drying times are measured for a similar wash process as described under test 1B, so rinsing with fresh water, but now 50 ppm of a surfactant is added in the main wash process together with the other main wash components. These levels implicate that the detergent contains about 5 wt-% surfactant.

These results of test 1 C, 1 D, 1 E and 1F show that the presence of relatively low levels of certain non-ionics (like in these examples Adekanol B2020, Plurafac LF 303, mixture of Pluarafac LF 303 with LF 221 or Surfonic LF 17) in the main wash reduces the drying times on various substrates enormously as compared to the test without rinse components (test 1B). These drying times are especially reduced for the following substrates: ceramic cup, plastic trays, cutlery and pale blue cups. Without rinse components, these substrates are drying very slowly (test 1B). The drying times of these most difficult to dry and very relevant substrates are reduced significantly by the presence of low levels of mentioned non-ionics. Even with these non-optimised systems, drying times are obtained which are comparable to the drying times for standard warewash system in which rinse components are dosed separately in the last rinse (test 1A).

These results also indicate that for drying substrates by the presence of certain non-ionics in the mainwash solution followed by rinsing with fresh fresh water lower levels of non-ionics (50 ppm) are needed than for drying via the standard warewash system (where in this example 120 ppm non-ionic) is used.

The results of 1 F and 1 G show that the drying performance of Surfonic LF 17 can be improved especially on ceramic and glass type of substrates by combining this non-ionic with the polymer Sokalan PM 70. These results indicate that for proper drying of a variety of substrates (based on f.i. ceramic, glass, metal and plastic material) combination of certain non-ionics with certain polymers in the main wash solution could be used.

Example 2

The warewasher used for these test series is an Electrolux Wash Tech 60 single tank machine. Specifications single tank hood machine (for example 2):

Type: Electrolux Wash Tech 60
Volume washbath: 40 L
Volume rinse: 4 L
Wash time: 60 seconds
Rinse time: 8 seconds
Wash temperature: 55-65° C.
Rinse temperature: 80-90° C.

Process

When the wash bath is filled with soft water and heated up, the wash program is started. The water will be circulated in the machine by the internal wash pump and by the wash arms over the dishware. When the wash time is over, the wash pump will stop. Then the rinse program will start, fresh warm water from the boiler (directly connected to a tap) will be rinsed by the rinse arms over the dishware. The rinse water will flow partly direct into the drain by an overflow pipe, the other part will flow into the wash bath. When the rinse time is over the machine is opened.

It should be noticed that also in this example only fresh water is rinsed over the substrates: no components from the main wash process can dissolve in the rinse water. The wash pump and wash arms and nozzles are not used for rinsing and the rinse water is not circulating in the wash tank during rinsing.

Working Method

A. The parameters for this test are set (wash cycle: 60 seconds at 60° C., rinse cycle: 8 seconds at 85° C.) and once the machine is filled with soft cold water, the surfactant to be tested mixed with a liquid main wash product (2 g/l LX) is added manually.

Key Components of LX

| As supplied | Corporate raw material name | Trade name |
|---|---|---|
| 20% | Sodium hydroxide (50%) | Caustic soda 50% |
| 50% | Nitrilotriacetic acid 3Na-salt (40%) | Trilon A liquid |
| 30% | Water | Water |

B. Drying times are measured on 4 different types of substrates:

2 blue ceramic plates
2 blue plastic plates
2 long drink glasses
2 blue plastic cups C. After the the rack with the above mentioned clean substrates is placed in the Electrolux machine, the wash cycle is runned and the timer is started as soon as the rinse cycle is finished. The rack out is removed out of the machine, the top of the cups and the glasses dried, and the drying time (in seconds) is determined for the washed substrates at ambient temperature. The wash cycle is repeated and the drying time measurements a second time with the same substrates and without adding any chemicals; the average drying times are calculated.

Drying Times Example 2

Average Drying Times

| | Drying times (sec) | | | |
|---|---|---|---|---|
| | 2 g/l LX (no rinse component) | 2 g/l LX + 20 ppm Plurafac LF303 | 2 g/l LX + 20 ppm Plurafac LF221 | 2 g/l LX + 10 ppm Plurafac LF303 + 10 ppm Plurafac LF 221 |
| blue porcelain plate | 80 | 65 | 60 | 50 |
| plastic blue plate | 300 | 120 | 120 | 120 |
| long drink glass | 300 | 60 | 60 | 40 |
| plastic cup | 300 | 100 | 200 | 60 |

These results show that, in line with the results from test-series 1A (with another machine and under different conditions), the presence of relatively low levels of certain non-ionics (like in these examples Plurafac LF 303 and Pluarafac LF 221) in the main wash reduces the drying times on various substrates enormously. These levels implicate that the detergent contains about 1 wt-% surfactant.

Furthermore, these results show that the mixture of LF 303 and LF 221 leads to best drying times, which is better than the average of the 2 separate drying times and better than the drying times of each separate system. These results indicate that improved, synergistic, drying effects are obtained by having certain combinations of non-ionics in the main wash process.

Example 3

The same machine and test conditions are used as described in example 2, but now attention is paid to visual appearance of the substrates after the drying process. The substrates are assessed visually with a score in the range from 1 (is very poor) to 5 (is very good) on the following aspects:

A. Filming: here drying pattern and formation of visual layer on the substrate s is evaluated; 1=unequal drying with visual layer on substrates; 5=equal drying and no visual layer on substrate.

B. Spotting: formation of droplets and stripes are evaluated after drying; 1=many drops and stripes; 5=perfectly dried with no drops and stripes.

By this evaluation of the visual appearance, the areas in contact with the rack, the edge of the plates, and the inside of the glasses and the cups are not considered. The wash cycle is repeated and the visual appearance assessments is done a second time with the same substrates and without adding any chemicals and the average values are calculated.

In these test series a comparison is made between

A. A wash system in which no rinse component is present and is rinsed with fresh water.

B. A reference test for a representative standard institutional dish wash process in which drying of the ware is obtained by rinsing with a rinse solution in which rinse aid is dosed. These rinse components are dosed via a separate rinse pump just before the boiler into the last rinse water. Three wash cycles are done before the test starts, in order to be sure that the rinse aid is homogenously distributed through the boiler. In this example Rinse Aid A is used as representative rinse aid for institutional warewashing. This neutral rinse aid contains 30% of a non-ionic mixture. By dosing this rinse aid at a level of 0.2 g/L, the concentration of non-ionics in the rinse solution is 60 ppm.

C. A wash system in which 20 ppm of a mixture of 2 nonionics (Plurafac LF 303 and LF 221) is added into the main wash process and where is rinsed with fresh water.

Results Visual Appearance Example 3

Average Values

| | Filming | | |
|---|---|---|---|
| | 2 g/l LX (no rinse component) | 2 g/l LX + 0.2 g/L Rinse Aid A (separate standard rinse) | 2 g/l LX + 10 ppm Plurafac LF303 + 10 ppm LF 221 |
| blue porcelain plate | 1 | 2 | 3 |
| plastic blue plate | 5 | 5 | 5 |
| long drink glass | 3 | 2.5 | 4 |
| plastic cup | 5 | 5 | 5 |

-continued

| | Spotting | | |
|---|---|---|---|
| | 2 g/l LX (no rinse component) | 2 g/l LX + 200 ppm Rinse Aid A | 2 g/l LX + 20 ppm Plurafac LF303/221 (1:1) |
| blue porcelain plate | 4 | 4.5 | 5 |
| plastic blue plate | 3 | 4.5 | 4.5 |
| long drink glass | 3 | 4 | 4 |
| plastic cup | 3 | 5 | 5 |

The results of these test series show that in general rinsing with rinse components present in the rinse solution (standard institutional warewash process) leads to improved visual appearance of the substrates: less filming and spotting is obtained.

This visual appearance is even better for the process in which certain non-ionics are present in the main wash process followed by rinsing with fresh water.

Example 4

The same machine and most of the test conditions were used as described in example 1. But in this example the rinse times with fresh water were varied from 0 to 25 seconds (and so the volume of fresh rinse water was varied from 0 to 12.5 L). This is done to test the effect of this parameter on the drying properties by surfactant present in the main wash of an institutional wash process. It is expected that surfactants, adsorbed onto the substrates during the main wash process, will desorp more when rinsing longer with fresh water. So, it is hypothesized that longer rinsing times will lead to longer drying times. As surfactant Triton EF 24 (from Dow) is used. In this example, the temperature of the main wash and the fresh rinse water were both 60 degrees C. These temperatures were kept constant in order to prevent that the drying properties are influenced by changing temperatures of the substrates.

In the table below the average drying times in seconds of 2 wash cycli for each of these tests are given. The substrates are ceramic plates (1), ceramic cups (2), glass bowls (3), plastic trays (4), cutlery (5) and pale blue cups (6).

| | | 1 | 2 | 3 | 4 | 5 | 6 |
|---|---|---|---|---|---|---|---|
| All tests 4A to 4F: Mainwash: 0.6 g/l STP + 0.37 g/l NaOH + 0.03 g/l NaDCCA | | | | | | | |
| 4A | No other components added to main wash and no rinse | 90 | 245 | 180 | 280 | 30 | 300 |
| Test 4B to 4F: 50 ppm EF 24 present in mainwash | Rinse time and volume | | | | | | |
| 4B | 0 sec (0 L) | 62 | 138 | 148 | 120 | 63 | 158 |
| 4C | 2 sec (1 L) | 81 | 110 | 163 | 108 | 65 | 300 |
| 4D | 8 sec (4 L) | 69 | 130 | 143 | 103 | 70 | 300 |
| 4E | 15 sec (7.5 L) | 58 | 105 | 133 | 120 | 40 | 290 |
| 4F | 25 sec (12.5 L) | 48 | 185 | 148 | 158 | 68 | 300 |

Test 4 a: Test with No Rinse Components and No Rinse Cycle

In this test, the drying times are measured for a wash process, without dosing rinse components neither rinsing with fresh water (parameter of rinse cycle: 0 sec)

This reference test shows that drying times are long, because no separate rinse aid is used and no specific surfactants are present in the main wash process.

Test 4 B Test in which Surfactant is Added in the Main Wash Process, and without Rinse Cycle In this test, the drying times are measured for a similar wash process as described under test 4A, so without rinsing, but now 50 ppm of the Triton EF24 surfactant is added together with other main wash components.

These results of test 4 B show that the presence of a relatively low level of the non-ionic Triton EF24 in the main wash reduces the drying times for most substrates significantly, even with no rinse cycle.

Test 4 C, D, E, F Test in which Surfactant is Present in the Main Wash Process and Rinsed with Fresh Water Only, with Various Rinse Times In these test series, the drying times are measured for a similar wash process as described under test 4 B, so adding 50 ppm of Triton EF24 as a surfactant together with the other main wash components, but now a rinse cycle of a certain duration is applied. The rinsing is done with fresh water only. These levels implicate that the detergent contains about 5 wt-% surfactant.

The results of test 4 C, 4 D, 4 E and 4 F show that under these conditions the drying behaviour caused by the presence of 50 ppm Triton EF 24 in the main wash is still good as long as not the rinse cycle with fresh water is 15 seconds or shorter (related to a volume of 7.5 L fresh water or less is rinsed over the substrates). However, when the rinse cycle with fresh water is 25 seconds (related to 12.5 L fresh water), then the drying takes longer. This indicates that the surfactants adsorbed during the main wash are desorbed from the substrates when 12.5 L or more fresh water is rinsed over the substrates during 25 seconds or longer. It should be noted that the desorption of surfactants from the substrate is not only determined by the rinse time, but also by factors like type of surfactant, water volume and flow properties.

These results illustrate that this washprocess in which substrates are dried by adsorption of the surfactant Triton EF 24 during the main wash and subsequent rinsing with fresh water is only suitable for wash processes with a short rinse cycle, as is the case for wash processes in institutional warewash machines.

Example 5

The same machine and test conditions are used as described in example 1. Parameters are: wash cycle: 30 seconds at 50° C., rinse cycle: 2 seconds at 80° C. with fresh water (1 L). In this example several specific type of surfactants were tested on their drying properties, when added to the main wash.

First (test 5A) the drying behaviour of this process with a standard rinse process is determined. In this standard rinse process a rinse aid is dosed in the separate rinse. Then (test 5B) the drying behaviour is determined for a wash process in which no rinse components are present (not dosed via the separate rinse and not added to the main wash process).

Then (tests 5 C up to 5 G) the drying behaviour is determined for various wash processes in which no rinse component is dosed in the separate rinsed (so rinsed only with fresh water) but where different type of surfactants are added to the main wash together with the other main wash components. These surfactants are:

Anticor A40 (test 5C)
Ferrocor Flash (test 5D)
PVP K-90 (test 5E)
Surfadone LP 100 (test SF)
Triton DF 12 (test 5G))

In the table below the average drying times in seconds of 3 wash cycli for each of these tests are given. The substrates are ceramic plates (1), ceramic cups (2), glass bowls (3), plastic trays (4) and cutlery (5).

| | | 1 | 2 | 3 | 4 | 5 |
|---|---|---|---|---|---|---|
| All tests 5 A to 5G: Mainwash: 0.6 g/l STP + 0.37 g/l NaOH + 0.03 g/l NaDCCA | | | | | | |
| 5A | No other components added to main wash; separate Rinse Aid A; 0.4 g/L. | 71 | 92 | 135 | 145 | 55 |
| 5B | No other components added to main wash: reference test. Surfactant added to main wash | 120 | 205 | 213 | 210 | 160 |
| 5C | 50 ppm Anticor A40 | 72 | 115 | 148 | 127 | 82 |
| 5D | 50 ppm Ferrocor Flash-R | 70 | 93 | 93 | 125 | 60 |
| 5E | 50 ppm PVP K-90 | 83 | 142 | 170 | 148 | 88 |
| 5F | 50 ppm Surfadone LP 100 | 75 | 120 | 152 | 188 | 79 |
| 5G | 50 ppm Triton DF 12 | 95 | 105 | 133 | 122 | 75 |

Test 5 A Reference Test for Standard Warewash Process

In this reference test the drying effects are measured for a representative standard institutional warewash process in which drying of the ware is obtained by rinsing with a rinse solution in which rinse aid is dosed. These rinse components are dosed via a separate rinsepump just before the boiler into the last rinse water. Three wash cycles are done before the test starts, in order to be sure that the rinse aid is homogenously distributed through the boiler.

In this example Rinse Aid A is used as representative rinse aid for institutional warewashing. This neutral rinse aid contains about 30% of a non-ionic mixture. By dosing this Rinse Aid at a level of 0.4 g/L, the concentration of non-ionics in the rinse solution is about 120 ppm.

Test 5 B Reference Test without the Presence of Specially Added Drying Components In this test, the drying times are measured for a similar wash process, but now without dosing rinse components in the rinse solution; so only rinsing with fresh water. These results show again that relatively long drying times are obtained; this confirms the effects of rinse components in the last rinse, which is current standard.

Test 5 C Till 5 G: Surfactants are Added in the Main Wash Process and Rinsed with Fresh Water Only In these test series, the drying times are measured for a similar wash process as described under test 5 B, so rinsing with fresh water; but now 50 ppm of a surfactant is present in the main wash process together with the other main wash components.

When comparing the drying results of test 5B (no surfactants present and rinsing with fresh water) with the results of tests 5 C till 5 G it can concluded that the drying times are reduced significantly by the presence of low levels of the following surfactants in the main wash: Anticor A40, Ferrocor Flash, PVP K-90, Surfadone LP 100 and Triton DF 12.

These drying times are similar or almost as good as drying caused by dosing much higher levels of standard rinse components in a separate rinse (test 5A).

Example 6

Addition of liquid material to a powder or granulated product can reduce the flow and dosing properties of this product. In this example, it is demonstrated how 5% of non-ionic can be incorporated in a granulated product without having a negative effect on flow and dosing properties, by addition of flow aid to this product.

Four test products, Formulation A, B, C and D, were made by mixing the raw materials as mentioned in the table below in the quantity and order as given. From these formulations the flow properties were determined by measuring the DFR (dynamic flow rate)-value.

The principle of the DFR (ml/s) determination is that a known volume of powder is permitted to flow through an orifice and the flow time is recorded. For the determination a glass tube of 50 cm length and 3.5 cm internal diameter is used. Further a brass orifice with a diameter of 2.25 cm and a metal slide for blocking the bottom of the tube are used.

The 2.25 cm diameter orifice is fitted to the tube. The orifice is closed with the metal slide and the tube is filled with the powder to be tested. The orifice is opened and the stopwatch started when the powder passes the upper graduation mark. The stopwatch is stopped when the powder passes the lower graduation mark and the elapsed time is noted. This is repeated twice more. The mean flow rate is calculated from the volume between the two marks and the time and reported in ml/sec. The determined DFR-values for the 4 test products are given in the table.

By the addition of 2% of flow aid, as is done for test formulations C and D, proper flow properties are obtained again, with DFR-values around 130-135 ml/s. The flow aids used in these test products are Aerosil 200 and Neosyl GP; silicone dioxide, raw materials with a very high active surface.

This example shows that the negative effects that addition of liquid surfactants can have on the flow properties of a powder type of product can be overcome by the incorporation of flow aids in these products.

Example 7

In order to obtain more insight in the surprising drying effects resulting from the presence of relatively low levels of surfactants in the wash solution of an institutional wash process, the contact angles of water on substrates contacted with these wash solutions were measured. It is hypothesized that the surfactants will adsorb onto the ware during the wash process. This adsorption will lead to reduced contact angles of water on these substrates, as compared to the same wash system without the presence of these surfactants. This reduced contact angle will lead to a thinner water layer after rinsing with water and so result into faster drying of the substrates.

To verify this hypothesis, the contact angle of water was measured on 3 different type of substrates, which have been in contact with different wash solutions, wich did contain no surfactant or different type of nonionics.

Test Method Contact Angle Measurement

Contact angle measurements were carried out using an FTA 200 (First Ten Angstroms)-apparatus. The Drop Shape

| Raw material | Trade name | Formulation A (no nonionic) | Formulation B (5% nonionic) | Formulation C (5% nonionic + flow aid X) | Formulation D (5% nonionic + flow aid Y) |
|---|---|---|---|---|---|
| Sodium tripolyphosphate (heavy density) | Europhos LV7 | 65.50 | 60.50 | 58.50 | 58.50 |
| Alcohol alkoxylate (EO/PO) | Triton EF-24 | — | 5.00 | 5.00 | 5.00 |
| Silicon dioxide (fumed) | Aerosil 200 | — | — | 2.00 | — |
| Silicon dioxide (precipitated) | Neosyl GP | — | — | — | 2.00 |
| Tallow fatty alcohol phosphate ester/$Na_2CO_3$ (50/50) | Libraphos 110 | 0.30 | 0.30 | 0.30 | 0.30 |
| Polyacrylic acid Na-salt (M = 4.5k) (powder) (92%) | Acusol 445NG | 2.00 | 2.00 | 2.00 | 2.00 |
| Sodium hydroxide (micropearl) | Caustic soda (micropearls) | 29.80 | 29.80 | 29.80 | 29.80 |
| Dichloroisocyanuric acid Na-salt.$2H_2O$ | NaDCCA 2aq | 2.40 | 2.40 | 2.40 | 2.40 |
| DFR (ml/s) | | 125 | 0 | 131 | 135 |

Formulation A represents a standard granulated warewash product for institutional warewash machines. This test product with a DFR-value of 125 ml/s has proper flow properties, does not lump, and can be dosed automatically into the machine. In general, a DFR-value above 100 ml/s implicates a free flowing powder.

Formulation B, in which 5% of the sodium tripolyphosphate is replaced by 5% of nonionic (Triton EF-24) has no free flowing properties at all under these conditions. The DFR-value is 0.

Method was applied during the measurements. For these tests flat pieces from the following substrates were used: glass, plastic tray and cutlery.

The effects occurring during the washing step of an institutional wash process were tried to simulate as close as possible. Therefore, these substrates were immersed in a beaker glass with soft water+50 ppm nonionic+2 g/l LX (composition see example 2), while stirring. These levels implicate that the detergent contains about 2.5 wt-% surfactant. The temperature of this 'wash solution' was 60° C. After 40 seconds the substrates were taken out of this solution and shaken to remove attached water and to let it dry. The contact angle was measured on these substrates by the Drop Shape Method, as follows:

A drop (20 μl of) soft water detaches from the dispensing needle and rests on a substrate as a 'sessile', or sitting drop. When the drop touches the substrate, the trigger is clicked by the user. After triggering, the contact angle is measured automatically by taking images at certain intervals. The effect of adsorption of the following nonionics on these substrates in the wash solution were tested: Adekanol B2020, Triton EF 24, Triton DF 12, Plurafac LF 303. These nonionics were selected because they resulted into faster drying of these substrates when present in a wash solution of an institutional wash process when rinsing with water only. To test the effect of these nonionics, a reference test is done in which no nonionic is present, but only the alkaline wash solution LX.

Contact Angles of Water Measured after 20 Seconds on 3 Different Type of Substrates for 5 Different Wash Solutions

| | Substrate: Glass Contact angle ° | Substrate: Plastic Tray Contact angle ° | Substrate: Cutlery Contact angle ° |
|---|---|---|---|
| LX; no nonionic (reference test) | 38 | 45 | 12 |
| LX; plus 50 ppm Adekanol B2020 | 16 | 37 | 3 |
| LX; plus 50 ppm Triton EF 24 | 7 | 16 | 3 |
| LX; plus 50 ppm Triton DF 12 | 20 | 32 | 10 |
| LX; plus 50 ppm Plurafac LF 303 | 7 | 39 | 7 |

These results show that the contact of water on substrates which have been in contact with a wash solution containing 50 ppm of the nonionics mentioned, is reduced as compared to the contact of water on similar substrates being in contact with a wash solution without these nonionics. These results confirm the hypothesis that these nonionic surfactants adsorb onto the ware during the washing step with a subsequent lowering of the contact angle of the rinse water, leading to reduced thickness of the rinsewater film and so resulting into faster drying of the substrates when rinsed with fresh water, under the conditions of an institutional wash process.

Example 8

In this example the impact of various polymeric surfactants and combinations with non-ionics on the drying behaviour of various substrates in an institutional warewash process is described. A standard institutional wash process is applied for this test with a main wash process containing metasilicate, phosphate and hypochlorite.

First (test 8A), the drying behaviour of the substrates is determined for a standard rinse process. In this standard rinse process, a rinse aid is dosed via a separate rinse pump just before the boiler into the last rinse water. In this example Rinse Aid A is used as representative rinse aid for institutional warewashing (details: see example 1).

Then (test 8B: Reference) the drying behaviour of the substrates is determined for a wash process in which no rinse components are present (not dosed via the separate rinse and not added to the main wash process). In this case, the mainwash contains only the main wash powder (metasilicate, phosphate and hypochlorite) and the rinse is done with fresh water.

Then (tests 8C to 8R) the drying behaviour is determined for various wash processes in which no rinse component is dosed in the separate rinsed (so rinsed only with fresh water) but where different surfactants are added to the main wash together with the other main wash components. The materials used as surfactant are:

Plurafac LF 300 (tests 8D to 8L); ex BASF; fatty alcohol alkoxylate

Plurafac LF 1300 (test 8C); ex BASF; fatty alcohol alkoxylate

Degressal SD 20 (tests 8D to 8N and 8P); ex BASF; fatty alcohol alkoxylate (polypropoxylate)

Alcosperse 602 TG (tests 8F, 8L); ex Alco; acrylic acid homopolymer (Mw 6000)

Sokalan CP9 (tests 8C and 8M to 80); ex BASF; maleic acid/olefin-copolymer, Na-salt (Mw 12000)

Sokalan CP5 (test 8D); ex BASF; maleic acid/acrylic acid copolymer, Na-salt (Mw 70000)

Sokalan PA40 (test 8E); ex BASF; polyacrylic acid, Na-salt (Mw 15000)

Sokalan PA15 (test 8G); ex BASF; polyacrylic acid, sodium salt (Mw 1200)

Versaflex SI (test 8H); ex Alco; acrylic copolymer

Alcosperse 175 (test 8I); ex Alco; maleic/acrylic acid copolymer (Mw 75000)

Narlex LD 36V (test 8J); ex Alco; acrylic acid copolymer (Mw 5000)

Narlex LD 54 (test 8K); ex Alco; acrylic acid copolymer (Mw 5000)

Casein (test 8Q); ex Aldrich (technical grade)

Inutec SP1 (test 8R); ex Orafti; hydrophobically modified (with C12 alkylchains) inulin (Mw 5000)

In the table below the concentrations of these materials in the mainwash solutions for each of the surfactants are mentioned. These levels implicate that the detergent contains about 2 to 7.5 wt-% surfactant in these various examples.

The same automated Hobart warewasher is used as described in example 1. The conditions and test procedure are comparable to the description in example 1. Key differences are:

Volume rinse: 4 L

Wash time: 29 seconds

Rinse time: 8 seconds

Wash temperature: 50° C.

Rinse temperature: 80° C.

Water: tap water (water hardness: 9 DH).

Working Method

Main wash powder is: 0.4 g/l sodium tripoly phosphate (STP; LV 7 ex-Rhodia)+0.285 g/l sodium metasilicate 0 aq (SMS 0 aq.)+0.285 g/l sodium metasilicates 5 aq (SMS 5 aq.)+0.03 g/l dichloroisocyanuric acid Na-salt 2 aq (NaDCCA).

Drying times are measured on 3 different types of substrates. These are coupons, which are difficult to dry in a institutional warewash process without rinse components and made of the following, practically relevant, materials:

2 glass coupons (148*79*4 mm)

2 plastic ('Nytralon 6E' (Quadrant Engineering Plastic Products); naturel) coupons (97*97*3 mm)

2 stainless steel (304) coupons (150*35*1 mm)

After the wash cycle (29 seconds) and rinse cycle (8 seconds with fresh tap water) the drying time is determined (in seconds) of the washed substrates at ambient temperature. When drying time is longer than 300 s, it is reported as 300 s. However, the plastic coupons are often not dried within five minutes. In that case, the remaining droplets on the coupons are counted.

The wash cycle and drying time measurements are repeated two more times with the same substrates without adding any chemicals. The substrates are replaced for every new test (in order not to influence the drying results by components possibly adsorbed onto the ware).

Results

The table below compiles the results of these tests series. For the stainless steel (1) and glass (2) coupons the average values of the drying times for the 3 repeat tests are given. For the plastic coupons (3), the average values of the number of droplets on the coupons after five minutes for the 3 repeat tests are given.

Test 8A confirms the effects of rinse components in the last rinse, which is current standard. The use of the standard process with the separate rinse aid leads to proper drying on all 3 substrates.

Test 8B shows that relatively long drying times or many water droplets on plastic are obtained when no rinse aid is used in the wash process.

Test 8C to 8R show that the presence of various surfactants at relatively low levels in the main wash can reduce drying times on stainless steel or glass, or number of water droplets on plastic significantly. Some of these drying behaviours are comparable or even better than for using a separate rinse aid.

One of the best surfactants in these examples is provided by test 8N, consisting of a combination of Sokalan CP9 and Degressal. SD20. Degressal SD 20 is also present in this composition as defoamer to prevent foam formation in a wash process with high mechanical forces. In test 8O and 8P the effect of each of these components is tested separately. These tests show that especially the presence of the polymeric surfactant Sokalan CP9 in the main wash leads to excellent drying behaviour under these conditions, where is rinsed with fresh tap water only.

| | | | | 1 | 2 | 3 |
|---|---|---|---|---|---|---|
| All tests 8 A to 8R: Mainwash: 0.4 g/l STP + 0.285 g/l SMS 0 aq. + 0.285 g/l SMS 5aq. + 0.03 g/l NaDCCA | | | | | | |
| 8A | No other components added to main wash; separate Rinse Aid A; 0.3g/L. | | | 73 | 112 | 2 |
| 8B | No other components added to main wash: reference test. | | | 241 | 281 | 36 |
| | Surfactant added to main wash | | | | | |
| 8C | | Plurafac LF1300 40 ppm | Sokalan CP9 30 ppm | 142 | 181 | 10 |
| 8D | Plurafac LF300 20 ppm | Degressal SD20 20 ppm | Sokalan CP5 30 ppm | 114 | 23 | 19 |
| 8E | Plurafac LF300 20 ppm | Degressal SD20 20 ppm | Sokalan PA40 30 ppm | 51 | 93 | 24 |
| 8F | Plurafac LF300 10 ppm | Degressal SD20 10 ppm | Alcosperse 602TG 40 ppm | 68 | 201 | 26 |
| 8G | Plurafac LF300 10 ppm | Degressal SD20 10 ppm | Sokalan PA15 40 ppm | 122 | 239 | 20 |
| 8H | Plurafac LF300 10 ppm | Degressal SD20 10 ppm | Versaflex SI 40 ppm | 141 | 245 | 11 |
| 8I | Plurafac LF300 10 ppm | Degressal SD20 10 ppm | Alcosperse 175 40 ppm | 82 | 290 | 15 |
| 8J | Plurafac LF300 10 ppm | Degressal SD20 10 ppm | Narlex LD 36V 40 ppm | 115 | 300 | 23 |

-continued

| | | | | 1 | 2 | 3 |
|---|---|---|---|---|---|---|
| 8K | Plurafac LF300 10 ppm | Degressal SD20 10 ppm | Narlex LD 54 40 ppm | 70 | 281 | 19 |
| 8L | Plurafac LF300 20 ppm | Degressal SD20 20 ppm | Alcosperse 602TG 30 ppm | 128 | 192 | 21 |
| 8M | | Degressal SD20 40 ppm | Sokalan CP9 10 ppm | 112 | 75 | 8 |
| 8N | | Degressal SD20 40 ppm | Sokalan CP9 20 ppm | 103 | 58 | 2 |
| 8O | | | Sokalan CP9 20 ppm | 75 | 114 | 4 |
| 8P | | Degressal SD20 40 ppm | | 300 | 253 | 19 |
| 8Q | | Degressal SD 20 30 ppm | Casein 50 ppm | 240 | 216 | 5 |
| 8R | | | Inutec SP1 50 ppm | 212 | 135 | 10 |

Example 9

In this example the impact of water hardness ions on the drying behaviour of a surfactant containing a polymeric and a nonionic surfactant in an institutional warewash process is determined.

In this example the main wash process contains phosphate, caustic and hypochlorite. For all these tests, no rinse component is dosed in the separate rinse so the substrates are rinsed only with fresh water.

First (test 9A), the drying behavior of the substrates are determined for a wash process in which no rinse components are present (not dosed via the separate rinse and not added to the main wash process). In this case, tap water is used and the mainwash contains only the main wash powder (phosphate, caustic and hypochlorite).

Besides these main wash components, also the following surfactants are present in test 9B to 9E: 40 ppm Degressal SD20 and 20 ppm Sokalan CP9. Furthermore, in these tests the impact of water hardness and addition of positively charged metal ions like calcium ($Ca^{2+}$) and magnesium ($Mg^{2+}$) ions are tested.

The process and working method are the same as described in example 8, except that the composition of the main wash powder in this example is: 0.6 g/l sodium tripoly phosphate (STP; LV 7 ex-Rhodia)+0.37 g/l caustic (NaOH)+0.03 g/l dichloroisocyanuric acid Na-salt 2 aq (NaDCCA).

Results

| Test | | 1 | 2 | 3 |
|---|---|---|---|---|
| All tests 9A to 9E: Mainwash: 0.6 g/l STPP + 0.37 g/l caustic + 0.03 g/l NaDCCA | | | | |
| 9A | No other components added to main wash: reference test in tap water. Tests 9B to 9E: present in main wash: 40 ppm Degressal SD20 + 20 ppm Sokalan CP9 | 280 | 274 | 27 |
| 9B | Tap water (9DH) | 223 | 110 | 12 |
| 9C | Soft water (0DH) | 283 | 232 | 23 |

-continued

| Test | | 1 | 2 | 3 |
|---|---|---|---|---|
| 9D | Soft water + 0.2 g/l $MgCl_2.6H_2O$ | 219 | 207 | 18 |
| 9E | Soft water + 0.2 g/l $CaCl_2.2H_2O$ | 171 | 167 | 11 |

The reference test (9A) has also been done with soft water and the use of magnesium and calcium chloride in soft water (same conditions as in tests 9C to 9E without the surfactant in the main wash). In each case, the results for the reference are comparable to what is obtained in tap water (test 9A).

Test 9A shows that relatively long drying times or many water droplets on plastic are obtained when no rinse components are used in the wash process.

Test 9B shows that the surfactant containing Sokalan CP9 and Degressal SD20 improves the drying behavior on all substrates in tap water: this results is in line with the effect measured in example 8N for a different main wash composition.

The effect on the drying behaviour of this surfactant is less pronounced without the presence of water hardness salts (as in test 9C in soft water).

The addition in the soft water of positively charged metal ions like calcium ($Ca^{2+}$) and magnesium ($Mg^{2+}$) ions (tests 9D and 9E) leads to faster drying on all substrates. Some of these drying behaviors are comparable or even better than with the use of tap water.

These examples indicate that the presence of water hardness ions or the addition of polyvalent metal ions leads to faster drying for an institutional warewash process in which this surfactant (Degressal SD20 and Sokalan CP9) is present in the main wash.

The invention claimed is:

1. A method of washing ware using a cleaning composition containing a surfactant, the method comprising:

(a) contacting ware in a washing step with an aqueous cleaning composition in an automatic institutional warewashing machine configured so that no carryover of the aqueous cleaning composition from the washing step into a rinse step occurs, the aqueous cleaning composition consisting of a major portion of water and about 200 to 5000 parts by weight of a warewashing detergent per each one million parts of the water; and (b) contacting the washed ware in a rinse step with a potable aqueous rinse, the aqueous rinse being substantially free of an intentionally added rinse agent, wherein the warewashing detergent contains a sufficient amount of a surfactant to provide a layer of the surfactant on the ware so as to afford sheeting action in the potable aqueous rinse step, wherein the method does not comprise a rinse step with a composition comprising an intentionally added rinse agent, further wherein the aqueous cleaning composition from the washing step does not carry over into the rinse step, further wherein the detergent is in the form of a solid, further wherein the detergent consists of the surfactant, at least one builder material, at least one caustic agent, at least one flow control agent, at least one antiscalant, optionally, at least one antifoam, and optionally, at least one bleach, further wherein the surfactant is present in an amount not to exceed 10 wt %, and further wherein the surfactant present in the detergent and the aqueous cleaning composition is selected from the group consisting of a hydrophobically modified polysaccharide, a maleic acid/olefin copolymer, and a maleic acid/olefin copolymer combined with a polypropoxylate.

2. The method of claim 1 wherein the surfactant provides an improved drying behaviour corresponding to the ratio of drying time using detergent with surfactant to drying time using detergent without surfactant being equal to or lower than 0.9.

3. The method of claim 1 wherein the surfactant is present in an amount not to exceed 7 wt-%.

4. The method of claim 1 wherein the automatic institutional warewashing machine is a single-tank machine or a multi-tank machine.

5. The method of claim 1 wherein the surfactant is selected from the group consisting of the maleic acid/olefin copolymer and the maleic acid/olefin copolymer combined with the polypropoxylate.

6. The method of claim 5 wherein the maleic acid/olefin copolymer has the formula

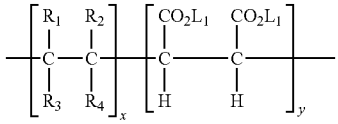

wherein $L_1$ is selected from the group consisting of hydrogen, ammonium, and an alkali metal; further wherein $R_1$, $R_2$, $R_3$, and $R_4$ are each independently selected from the group consisting of hydrogen and an alkyl group containing from 1 to 8 carbon atoms; further wherein the ratio of x to y is from about 1:5 to about 5:1; and further wherein the maleic acid/olefin copolymer is characterized by an average molecular weight of about 20,000 or less.

7. The method of claim 5 wherein the maleic acid/olefin copolymer has the formula

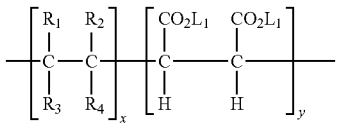

wherein $L_1$ is hydrogen or sodium, $R_1$ and $R_3$ are hydrogen, $R_2$ is methyl, $R_4$ is neopentyl, the ratio of x to y is about 1:1, and the maleic acid/olefin copolymer is characterized by an average molecular weight of about 12,000.

8. The method of claim 7 wherein the maleic acid/olefin copolymer is combined with calcium ions or magnesium ions or both.

9. The method of claim 8 wherein the surfactant is the maleic acid/olefin copolymer combined with the polypropoxylate.

10. The method of claim 1, wherein the detergent consists of the surfactant, the at least one builder material, the at least one caustic agent, the at least one flow control agent, the at least one antiscalant, the at least one antifoam, and the at least one bleach.

11. A method of washing ware using a cleaning composition containing a surfactant, the method comprising:

(a) contacting ware in a washing step with an aqueous cleaning composition in an automatic institutional warewashing machine configured so that no carryover of the aqueous cleaning composition from the washing step into a rinse step occurs, the aqueous cleaning composition consisting of a major portion of water and about 200 to 5000 parts by weight of a warewashing detergent per each one million parts of the water; and (b) contacting the washed ware in a rinse step with a potable aqueous rinse, the aqueous rinse being substantially free of an intentionally added rinse agent, wherein the warewashing detergent contains a sufficient amount of a surfactant to provide a layer of the surfactant on the ware so as to afford sheeting action in the potable aqueous rinse step, wherein the method does not comprise a rinse step with a composition comprising an intentionally added rinse agent, further wherein the aqueous cleaning composition from the washing step does not carry over into the rinse step, further wherein the detergent consists of the surfactant, at least one builder material, at least one caustic agent, at least one flow control agent, at least one antiscalant, optionally, at least one antifoam, and optionally, at least one bleach, further wherein the surfactant is present in an amount not to exceed 10 wt %, and further wherein the surfactant present in the detergent and the aqueous cleaning composition is selected from the group consisting of a hydrophobically modified polysaccharide, a maleic acid/olefin copolymer, and a maleic acid/olefin copolymer combined with a polypropoxylate.

12. The method of claim 11 wherein the surfactant is selected from the group consisting of the maleic acid/olefin copolymer and the maleic acid/olefin copolymer combined with the polypropoxylate.

13. The method of claim 12 wherein the maleic acid/olefin copolymer has the formula

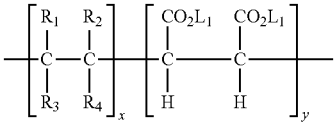

wherein $L_1$ is selected from the group consisting of hydrogen, ammonium, and an alkali metal; further wherein $R_1$, $R_2$, $R_3$, and $R_4$ are each independently selected from the group consisting of hydrogen and an alkyl group containing from 1 to 8 carbon atoms; further wherein the ratio of x to y is from about 1:5 to about 5:1; and further wherein the maleic acid/olefin copolymer is characterized by an average molecular weight of about 20,000 or less.

14. The method of claim 12 wherein the maleic acid/olefin copolymer has the formula

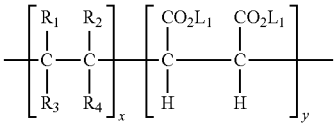

wherein $L_1$ is hydrogen or sodium, $R_1$ and $R_3$ are hydrogen, $R_2$ is methyl, $R_4$ is neopentyl, the ratio of x to y is about 1:1, and the maleic acid/olefin copolymer is characterized by an average molecular weight of about 12,000.

15. The method of claim 14 wherein the maleic acid/olefin copolymer is combined with calcium ions or magnesium ions or both.

16. The method of claim 15 wherein the surfactant is the maleic acid/olefin copolymer combined with the polypropoxylate.

17. The method of claim 11, wherein the detergent consists of the surfactant, the at least one builder material, the at least one caustic agent, the at least one flow control agent, the at least one antiscalant, the at least one antifoam, and the at least one bleach.

18. The method of claim 11 wherein the automatic institutional warewashing machine is a single-tank machine or a multi-tank machine.

* * * * *

UNITED STATES PATENT AND TRADEMARK OFFICE

CERTIFICATE OF CORRECTION

PATENT NO. : 8,876,982 B2
APPLICATION NO. : 11/416770
DATED : November 4, 2014
INVENTOR(S) : Antonius Maria Neplenbroek et al.

It is certified that error appears in the above-identified patent and that said Letters Patent is hereby corrected as shown below:

ITEM (75) ON THE TITLE PAGE

Delete the inventor name "Perrino Marie Portier" and replace with the inventor name --Perrine Marie Portier--

Signed and Sealed this
Sixth Day of October, 2015

Michelle K. Lee

Michelle K. Lee
*Director of the United States Patent and Trademark Office*